United States Patent [19]

Lewis

[11] Patent Number: 4,904,497

[45] Date of Patent: Feb. 27, 1990

[54] ELECTROMAGNETIC SOLDER TINNING METHOD

[75] Inventor: Brian G. Lewis, Branford, Conn.

[73] Assignee: Olin Corporation, Cheshire, Conn.

[21] Appl. No.: 140,694

[22] Filed: Jan. 4, 1988

Related U.S. Application Data

[62] Division of Ser. No. 26,429, Mar. 16, 1987.

[51] Int. Cl.[4] ..... B05D 3/14

[52] U.S. Cl. ..... 427/47; 427/45.1; 427/424; 427/433; 427/434.2; 427/436; 427/443.2

[58] Field of Search ..... 427/47, 117, 434.7, 427/435, 45.1, 424, 433, 434.2, 436, 443.2

[56] References Cited

U.S. PATENT DOCUMENTS

| | | | |
|---|---|---|---|
| 2,291,720 | 8/1942 | Hukle | 427/47 |
| 2,824,021 | 2/1958 | Cook et al. | 427/45.1 |
| 2,834,692 | 5/1958 | Tama | 427/46 |
| 3,518,109 | 6/1970 | Halley | 117/93.2 |
| 3,605,865 | 9/1971 | Getselev | 164/503 |
| 3,646,988 | 3/1972 | Getselev | 164/503 |
| 3,917,888 | 11/1975 | Beam et al. | 427/433 |
| 3,939,799 | 2/1976 | Kanbara et al. | 118/620 |
| 4,014,379 | 3/1977 | Getselev | 164/452 |
| 4,033,398 | 7/1977 | Laithwaite | 164/467 |
| 4,078,103 | 3/1978 | Thornton et al. | 427/349 |
| 4,161,206 | 7/1979 | Yarwood et al. | 164/467 |
| 4,471,832 | 9/1984 | Yarwood et al. | 164/503 |
| 4,530,394 | 7/1985 | Yarwood et al. | 164/467 |
| 4,530,851 | 7/1985 | Shannon et al. | 427/9 |
| 4,572,279 | 2/1986 | Lewis et al. | 164/463 |

*Primary Examiner*—Bernard Pianalto
*Attorney, Agent, or Firm*—H. S. Kieser

[57] ABSTRACT

The present invention relates to an electromagnetic system for applying a coating to a metal or metal alloy substrate. The system utilizes a high frequency electromagnetic field to maintain a supply of coating material in a molten condition, to restrict the flow of the molten coating material, and to control the thickness of the applied coating layer. Downstream cooling solidifies the coating layer. The system has particular utility in forming tin coated copper or copper base alloy products.

9 Claims, 2 Drawing Sheets

ELECTROMAGNETIC SOLDER TINNING METHOD

This application is a division of application Ser. No. 26,429, filed Mar. 16, 1987.

The present invention relates to a process and apparatus for coating metal or metal alloy strip material.

It is known that liquid metal can be moved or constrained when subjected to mechanical pressure by the induction of electrical currents in the metal. For example, systems for electromagnetically casting metals or metal alloys are commercially available. In these systems, an electromagnetic field is used to contain the molten metal being cast. The casting apparatus generally includes a three piece mold consisting of a water cooled inductor, a non-magnetic screen, and a manifold for applying cooling water to the forming ingot. Containment of the molten metal is achieved without direct contact between the molten metal and any component of the mold. Solidification of the molten metal is accomplished by direct application of water from the cooling manifold to the ingot skin. U.S. Pat. Nos. 3,605,865 to Getselev, 3,646,988 to Getselev, 4,014,379 to Getselev, 4,161,206 to Yarwood et al. and 4,530,394 to Yarwood et al. illustrate some of the electromagnetic casting systems known in the art. U.K. Patent No. 1,499,809 to Gregory et al. illustrates an electromagnetic casting system for forming metal rod.

It is also known that by creating particular types of electromagnetic fields, one can shape molten metal. For example, U.S. Pat. No. 4,471,832 to Yarwood et al. illustrates an apparatus and process for electromagnetically forming a material into a desired thin strip shape. U.S. Pat. No. 4,572,279 to Lewis et al. illustrates a system for electromagnetically shaping thin ribbon conductor strip cast onto a chill wheel.

U.S. Pat. No. 3,463,365 to Dumont-Fillon and U.K. Patent No. 1,481,301 are exemplary of the art relating to the use of electromagnetic fields for controlling metal flow from a tundish or crucible into a mold. In the British patent, the electromagnetic field is not only used to control the flow of molten metal from the crucible but also to keep the molten metal from flowing against the refractory portion of the crucible and thereby prevent erosion of the refractory.

Finally, electromagnetic fields have been used to control the width of coating layers. In U.S. Pat. No. 4,033,398 to Laithwaite, a layer of metal is cast on a surface of a metal backing. While the cast metal is still molten, a varying electromagnetic force is generated along the edges of the strip. This electromagnetic force induces currents within the molten metal. The resulting mechanical force exerted in the molten metal is such that the metal is restrained from flowing to the edges of the strip.

There are many different techniques known in the art for forming coated metal strip. One of the primary concerns in all coating techniques is the uniformity of the applied coating. Generally, it is preferred that the coating extend substantially uniformly across the width of the substrate and possess a substantially uniform thickness. Uneven coatings can be troublesome and excessive coating layers can significantly increase the cost of a coating process. It is known in the art to use fluid systems to finish off a coating and provide it with the desired uniformity. These systems typically remove excess coating material by impinging a gaseous fluid on the coating material. U.S. Pat. Nos. 3,917,888 to Beam et al. and 4,078,103 to Thornton et al. illustrate such systems. Unfortunately, not all of these systems are perfect. The application of too much local fluid pressure can create bare spots and localized uneveness in the coating.

Accordingly, it is an object of the present invention to provide a process and apparatus for forming a coated metal or metal alloy substrate.

It is a further object of the present invention to provide a process and apparatus as above for applying a controlled, relatively thin, substantially uniform coating to the substrate.

It is a further object of the present invention to provide a process and apparatus as above for applying a tin coating to a copper or copper base alloy substrate.

These and other objects and advantages will become more apparent from the following description and drawings in which like reference numerals depict like elements.

The present invention relates to an electromagnetic system for applying a coating to a metal or metal alloy substrate. The system utilizes a high frequency electromagnetic field to melt a supply of coating material and/or maintain the coating material in a molten condition, to restrict the flow of molten coating material, and to control the thickness of the applied coating layer(s). Downstream cooling solidifies the coating layer and places the composite product into its final form. The system has particular utility in forming tin solder coated copper or copper base alloy materials.

Figure 1:
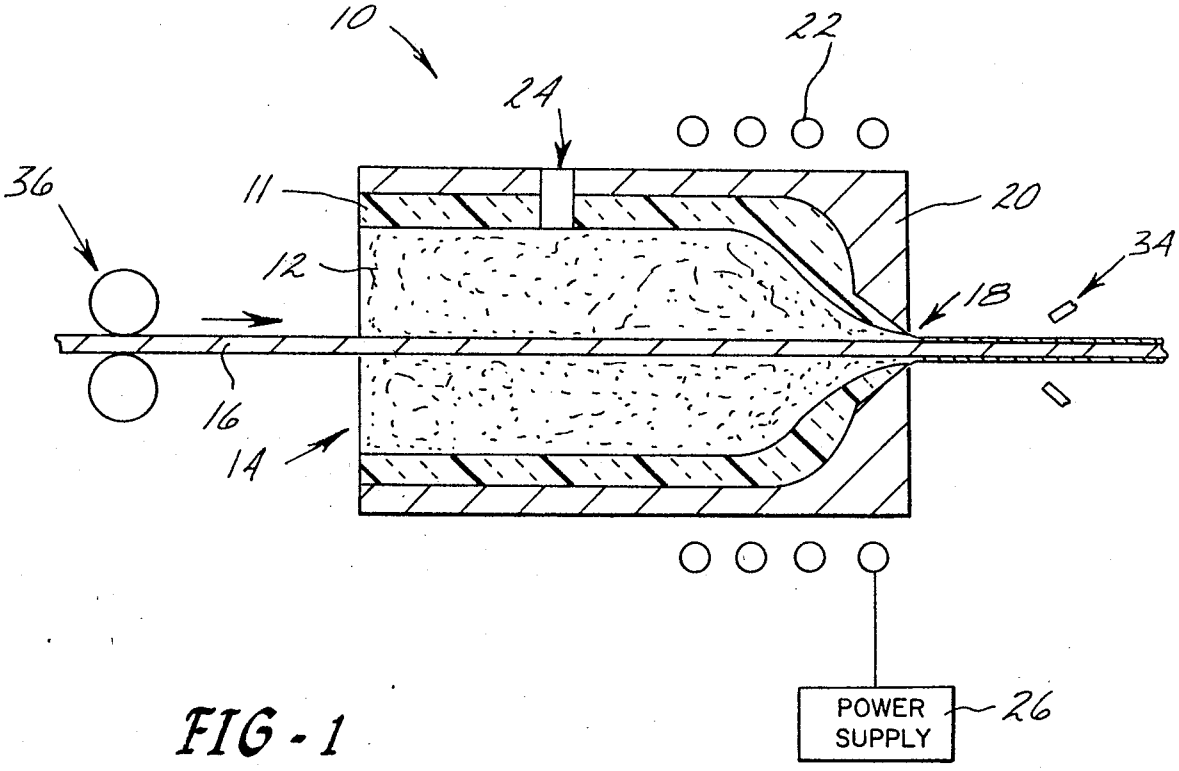
FIG. 1 is a schematic view in partial cross section of the coating apparatus of the present invention.
Figure 3:
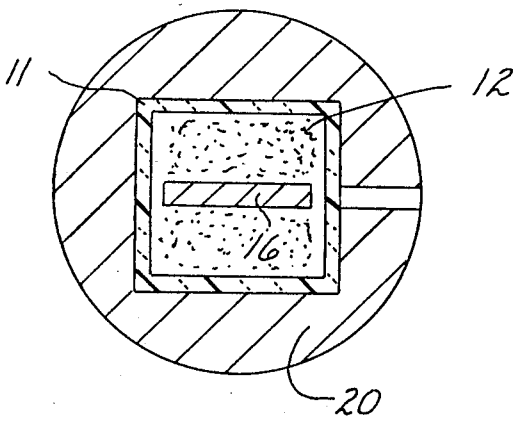
FIG. 3 is an end view of the inlet portion of the coating apparatus.
Figure 4:
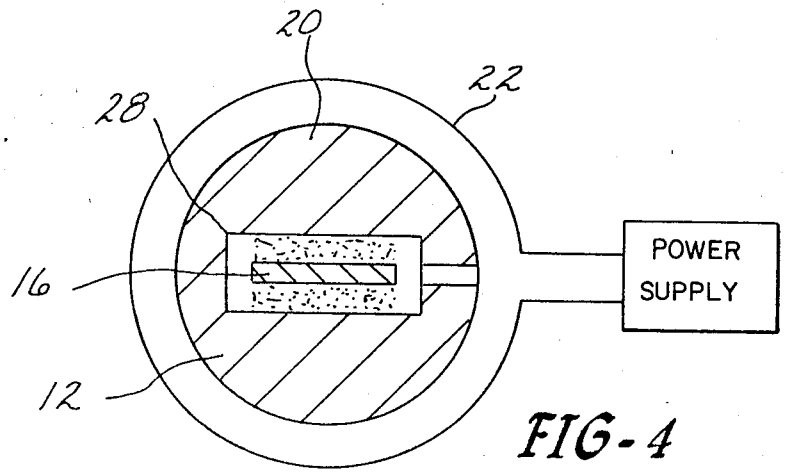
FIG. 4 is an end view of the outlet portion of the coating apparatus.

An apparatus is described herein for forming a laminate or composite comprising a metal or metal alloy substrate having at least one surface coated with a layer of metal or metal alloy material. While the apparatus will be described in terms of coating metal strip, it should be recognized that it may be used to coat other forms of metallic and wettable non-metallic materials including but not limited to those in foil, rod, wire, or bar form. Similarly, it should be recognized that the apparatus may be utilized to apply coating materials other than tin or tin alloy solders or brazing materials to base materials other than copper or copper base alloys.

The coating apparatus 10 has three major components. These are a crucible or container 11 for holding a supply of coating material 12, an inductor 22 for creating a high frequency electromagnetic field, and a flux concentrator 20 for intensifying and shaping the electromagnetic field in the region of the exit or outlet 18.

The container 11 for holding a supply of coating material 12 may be a liner formed from any suitable material known in the art. Preferably, it is formed from a non-electrically conductive material having a relatively low thermal conductivity. Suitable container materials include alumina, quartz and other ceramics. The container 11 may have any desired cross sectional shape. Besides an inlet 14 through which a substrate 16 to be coated enters and an outlet 18 through which the coated substrate exits, the container 11 may have an opening 24 through which a coating material 12 may be supplied. If desired, a cover not shown may be provided for sealing the opening 24.

The coating material 12 may be any coating material. For example, it may be a tin or tin alloy solder material or some other metallic coating or brazing material. The only general limiting feature on the type of coating material employed is that it should have a melting point lower than the melting point of the substrate. The coating material may be supplied to the container 11 in any desired form either continuously, semi-continuously, or in a batchwise fashion. The inductor 22 is used to generate a high frequency electromagnetic field. Any suitable induction coil known in the art having one or more turns may be used as the inductor 22. For example, the inductor 22 could be a multi-turn, water cooled copper coil. The inductor 22 may be mounted about the container 11 in any desired manner known in the art to surround any desired portion of the container. Preferably, the inductor 22 is mounted close to the exit or outlet portion of the container 11.

A power supply 26 is connected to the inductor 22 to provide it with a desired current at a desired frequency. The applied current excites the inductor 22 and thereby creates the electromagnetic field. The power supply 26 may be any suitable power supply known in the art such as an alternating current generator.

The flux concentrator 20 lies intermediate the inductor 22 and the container 11. Its primary function is to intensify and shape the magnetic field to generate magnetic back-pressure forces that restrict or dam the flow of the molten coating material 12 through the outlet 18 and form the molten coating material into a layer of desired thickness T. This is achieved by using a high conductivity metal or metal alloy concentrator such as one formed from OFHC copper. Further, flux concentration is accomplished by providing a shaped slot 28. As in any flux concentrator, the electromagnetic field from the inductor 22 induces current(s) within the body of the concentrator. Each induced current of course follows the path of least electrical impedance. In the present case, the induced current(s) will flow about the slot 28. By appropriately shaping the slot 28, an electromagnetic field for generating the desired magnetic forces can be created. For coating metal strip, the slot 28 may have a shape similar to that shown in the Figures. The flux concentrator 20 may have a unitary construction or may be formed from a plurality of joined sections.

The coating apparatus 10 further includes a means not shown for pulling the substrate 16 to be coated through the coating material 12 at a desired speed. These pulling means may comprise any suitable device known in the art such as a powered take-up reel.

Still further, the apparatus 10 includes a means 34 for solidifying the coating material. The solidifying means 34 may comprise nozzles for spraying a cooling material or some other conventional cooling device.

The apparatus 10 may also include means 36 for fluxing one or more substrate surfaces prior to the substrate entering the container 11. The flux applying means 36 may comprise any suitable means known in the art such as flux applying wheels. Additionally, the apparatus 10 may include means not shown for preheating the material to be coated. Any suitable means known in the art may be used to preheat the material.

In operation, a time varying current at a desired frequency is applied to the inductor 22 to generate a desired high frequency electromagnetic field. This electromagnetic field is then shaped and intensified by the flux concentrator 20 in the manner previously discussed. The shaped electromagnetic field is then used for several purposes. First, it is used to generate heat within the coating material 12. If the coating material is supplied to the container in solid form, the electromagnetic field should have sufficient strength to create enough resistive heating to heat and keep molten the coating material. If the coating material is supplied in molten form, then the electromagnetic field should be capable of creating enough heat to maintain the material 12 in a molten condition.

Figure 2:
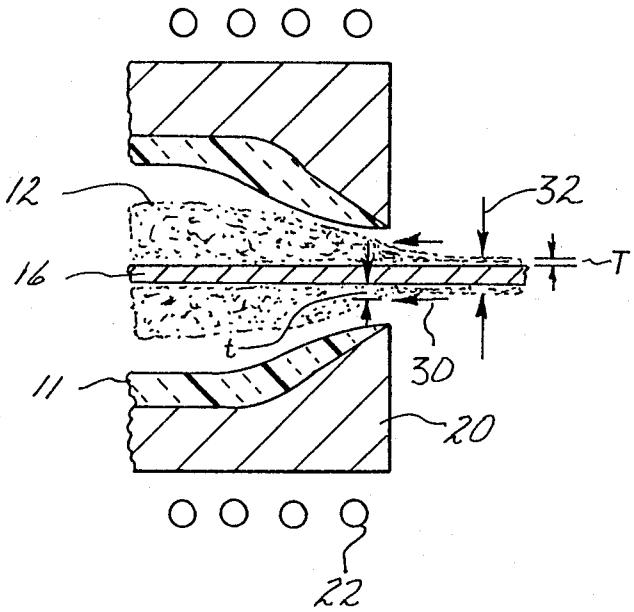
FIG. 2 is an exploded view of the outlet portion of the apparatus of FIG. 1.

Second, the electromagnetic field is used to create a magnetic back-pressure for restricting the flow of the molten coating material through the container outlet 18 and thereby controlling the thickness of the coating layer(s) 38. These back-pressure forces are created by the electromagnetic field inducing eddy currents within the molten coating material 12. These eddy currents in turn interact with the electromagnetic field to produce the magnetically derived pressure forces. As shown in FIG. 2, two types of magnetic pressure forces are created.

The first type of force is a gradient force 30 which acts parallel to the direction of travel of the substrate 16 through the coating material and which restricts or dams the flow of the molten coating material through the outlet 18. The gradient forces 30 each have a magnitude which is related to the geometry of the flux concentrator 20 at the outlet 18. The other type of magnetic force is a Lorentz pressure force 32. This force acts perpendicular to the gradient forces and by adjustment of the current in the inductor presses the molten coating material into a coating layer of desired thickness. It is believed that these pressure forces will also form a substantially uniform coating across the width of the wetted portion of the substrate.

The thickness T of each applied coating layer 38 is related to the speed of the moving substrate, the conductivity of the substrate, auxiliary cooling, and the depth t of the dammed coating material 12 adjacent the outlet 18. For most tin coated copper strip products, the layer 38 will have a thickness in the range of from about $0.1\times10^{-3}$ to about $2\times10^{-3}$ cms. Typically, the thickness T in such applications will be in the range of from about $0.5\times10^{-3}$ to about $1.5\times10^{-3}$ cms.

Generally, the dammed coating material depth t is three times the skin or penetration depth δ of the magnetic field. Skin depth δ is ordinarily defined by the following equation:

$$\delta = \sqrt{\frac{2\,\rho_e}{2\pi\mu o f}} \qquad (1)$$

where $\rho_e$=electrical resistivity of the coating material;

$\mu o$=permeability of free space; and f=frequency of the electromagnetic field.

Thus, the dammed coating material depth thickness t may be defined by the following equation:

$$t = \sqrt[3]{\frac{2\rho_e}{2\pi\mu of}} \quad (2)$$

To produce a typical tin coated copper strip product, the dammed coating material depth will be in the range of from about 0.05 cm. to about 0.1 cm. From these considerations, it is possible to determine the frequency which is needed to generate an electromagnetic field having sufficient coupling to apply the tin solder coating to a moving copper base substrate in the desired manner. For the above dammed coating material depth range, the applied frequency should be in the range of from about 5 kHz to about 3 MHz.

Generally, it is undesirable to use the electromagnetic field to support high heads of molten coating material. This is because the electromagnetic field required to support such metallostatic loads would demand excessively high containment currents with a concomitant increase in the temperature of the molten metal to undesirable levels, i.e. levels at which unwanted intermetallics can form and the quality of the coating deteriorates. In the extreme, the temperature of the molten coating material could be raised above the melting point of the substrate.

The U.S. patents and foreign patent publications set forth in the specification are intended to be incorporated by reference herein.

It is apparent that there has been provided in accordance with this invention an electromagnetic solder tinning system which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. A process for applying a coating material having a desired thickness to at least one surface of a substrate, said process comprising:

providing a container having an inlet and an outlet and a supply of coating material within said container;

passing a substrate to be coated through said inlet into contact with said coating material;

providing an inductor adjacent to the outlet of said container; and supplying a time varying current at a desired frequency to said conductor to create magnetic forces for restricting the flow of said coating material through said outlet and for controlling the thickness of said coating material applied to said substrate.

2. The process of claim 1 further comprising:

providing a flux concentrator intermediate said inductor and said container; and intensifying and shaping said electromagnetic field in the vicinity of said outlet with said flux concentrator.

3. The process of claim 1 further comprising said electromagnetic field creating sufficient heat within said coating material to maintain said coating material in a molten condition.

4. The process of claim 1 wherein:

said coating material supply step comprises providing a supply of solder or brazing material; and said passing step comprises passing a metal or metal alloy strip through said solder or brazing material.

5. The process of claim 1 wherein:

said coating material supply step comprises providing a supply of molten tin or tin alloy in said container; and said passing step comprises passing a copper or copper base alloy strip through said molten tin or tin alloy material.

6. The process of claim 1 further comprising:

solidifying said coating material on said substrate.

7. The process of claim 6 wherein said solidifying step comprises spraying a fluid onto said coating material.

8. The process of claim 1 further comprising:

fluxing said substrate prior to passing said substrate through said coating material.

9. The process of claim 1 including the step of varying said frequency to control the thickness of said coating material.

* * * * *